US006986566B2

(12) United States Patent
Delametter et al.

(10) Patent No.: US 6,986,566 B2
(45) **Date of Patent: *Jan. 17, 2006**

(54) LIQUID EMISSION DEVICE

(75) Inventors: Christopher N. Delametter, Rochester, NY (US); James M. Chwalek, Pittsford, NY (US); David P. Trauernicht, Rochester, NY (US); David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 35 days.

This patent is subject to a terminal disclaimer.

(21) Appl. No.: 10/706,199

(22) Filed: Nov. 12, 2003

(65) Prior Publication Data

US 2004/0179069 A1 Sep. 16, 2004

Related U.S. Application Data

(63) Continuation-in-part of application No. 10/273,916, filed on Oct. 18, 2002, now Pat. No. 6,761,437, which is a continuation-in-part of application No. 09/470, 638, filed on Dec. 22, 1999, now Pat. No. 6,497,510.

(51) Int. Cl.
*B41J 2/02* (2006.01)

(52) U.S. Cl. ..... 347/73; 347/47

(58) Field of Classification Search ..... 347/44, 347/45, 47, 54, 56, 61, 63–65, 67, 92–94, 347/73–74, 77, 82

See application file for complete search history.

(56) References Cited

U.S. PATENT DOCUMENTS

| | | | | |
|---|---|---|---|---|
| 1,941,001 | A | 12/1933 | Hansell | 178/96 |
| 3,373,437 | A | 3/1968 | Sweet et al. | 347/74 |
| 3,416,153 | A | 12/1968 | Hertz et al. | 347/73 |
| 3,878,519 | A | 4/1975 | Eaton | 347/75 |
| 3,893,623 | A | 7/1975 | Toupin | 347/82 |
| 4,346,387 | A | 8/1982 | Hertz | 347/75 |
| 4,490,728 | A | 12/1984 | Vaught et al. | 347/56 |
| 4,580,149 | A | 4/1986 | Domoto et al. | 347/61 |
| 4,847,630 | A | 7/1989 | Bhaskar et al. | 347/63 |
| 4,982,199 | A | 1/1991 | Dunn | 347/15 |
| 5,016,024 | A | 5/1991 | Lam et al. | 347/63 |
| 5,109,234 | A | 4/1992 | Otis, Jr. et al. | 347/14 |
| 5,502,471 | A | 3/1996 | Obermeier et al. | 347/65 |
| 5,734,395 | A | 3/1998 | Kamisuki et al. | 347/54 |
| 5,746,373 | A | 5/1998 | Sanada | 347/68 |

(Continued)

FOREIGN PATENT DOCUMENTS

| | | |
|---|---|---|
| EP | 0 354 982 | 2/1990 |

(Continued)

OTHER PUBLICATIONS

The 12th International Conference on Solid State Sensors, Acutators and Microsystems, Boston, Jun. 8-12, 2003; 2C3.5, pp. 380-383, by S. Shin et al.

(Continued)

*Primary Examiner*—Juanita D. Stephens
(74) *Attorney, Agent, or Firm*—William R. Zimmerli

(57) ABSTRACT

An emission device for ejecting a liquid drop is provided. The device includes a body. Portions of the body define an ink delivery channel and other portions of the body define a nozzle bore. The nozzle bore is in fluid communication with the ink delivery channel. An obstruction having an imperforate surface is positioned in the ink delivery channel. The emission device can be operated in a continuous mode and/or a drop on demand mode.

31 Claims, 13 Drawing Sheets

U.S. PATENT DOCUMENTS

| | | | | |
|---|---|---|---|---|
| 5,760,804 | A | 6/1998 | Heinzl et al. | 347/56 |
| 5,841,452 | A | 11/1998 | Silverbrook | 347/47 |
| 5,886,716 | A | 3/1999 | Heinzl et al. | 347/48 |
| 5,966,154 | A * | 10/1999 | DeBoer | 347/82 |
| 6,019,457 | A | 2/2000 | Silverbrook | 347/65 |
| 6,022,099 | A | 2/2000 | Chwalek et al. | 347/57 |
| 6,023,091 | A | 2/2000 | Koch et al. | 257/536 |
| 6,045,214 | A * | 4/2000 | Murthy et al. | 347/47 |
| 6,079,821 | A | 6/2000 | Chwalek et al. | 347/82 |
| 6,102,530 | A | 8/2000 | Kim et al. | 347/65 |
| 6,193,344 | B1 | 2/2001 | Otsuka et al. | 347/11 |
| 6,273,553 | B1 | 8/2001 | Kim et al. | 347/48 |
| 6,296,350 | B1 | 10/2001 | Cornell et al. | 347/60 |
| 6,331,039 | B1 | 12/2001 | Iwasaki et al. | 347/11 |
| 6,382,782 | B1 | 5/2002 | Anagnostopoulos et al. | 347/73 |
| 6,412,928 | B1 | 7/2002 | Anagnostopoulos et al. | 347/77 |
| 6,422,677 | B1 | 7/2002 | Deshpande et al. | 347/14 |
| 6,439,691 | B1 | 8/2002 | Lee et al. | 347/48 |
| 6,439,703 | B1 | 8/2002 | Anagnostopoulos et al. | 347/75 |
| 6,460,961 | B2 | 10/2002 | Lee et al. | 347/15 |
| 6,471,338 | B2 | 10/2002 | Chen et al. | 347/59 |
| 6,497,510 | B1 | 12/2002 | Delametter et al. | 347/74 |
| 6,554,410 | B2 | 4/2003 | Jeanmaire et al. | 347/77 |
| 6,561,625 | B2 | 5/2003 | Maeng et al. | 347/47 |
| 6,561,626 | B1 | 5/2003 | Min et al. | 347/47 |
| 6,588,888 | B2 | 7/2003 | Jeanmaire et al. | 347/77 |
| 6,761,437 | B2 * | 7/2004 | Delametter et al. | 347/73 |
| 2002/0113843 | A1 | 8/2002 | Anagnostopoulos et al. | |

FOREIGN PATENT DOCUMENTS

| | | |
|---|---|---|
| EP | 0 474 472 | 3/1992 |
| EP | 0 805 036 | 11/1997 |
| EP | 0 308 272 | 3/1999 |
| EP | 0 911 167 | 4/1999 |
| JP | 6-183029 | 7/1994 |

OTHER PUBLICATIONS

The 12th International Conference on Solid State Sensors, Actuators and Microsystems, Boston, Jun. 8-12, 2003; 2E18.P, pp. 472-475, by by S. S. Baek, et al.

Journal of Microelectromechanical Systems,. vol. 11, No. 5, Oct. 2002, pp. 427-437, by Fan-Gang Tseng, et al.

* cited by examiner

LIQUID EMISSION DEVICE

CROSS REFERENCE TO RELATED APPLICATIONS

This application is a continuation-in-part of U.S. patent application Ser. No. 10/273,916, filed Oct. 18, 2002, now U.S. Pat. No. 6,761,437 B2, and assigned to the Eastman Kodak Company which is a continuation-in-part of U.S. patent application Ser. No. 09/470,638, filed Dec. 22, 1999, now U.S. Pat. No. 6,497,510, and assigned to the Eastman Kodak Company.

FIELD OF THE INVENTION

The present invention relates generally to micro electromechanical (MEM) liquid emission devices such as, for example, inkjet printing systems, and more particularly such devices which employ a thermal actuator in some aspect of drop formation.

BACKGROUND OF THE PRIOR ART

Ink jet printing systems are one example of digitally controlled liquid emission devices. Ink jet printing systems are typically categorized as either drop-on-demand printing systems or continuous printing systems.

Until recently, conventional continuous ink jet techniques all utilized, in one form or another, electrostatic charging tunnels that were placed close to the point where the drops are formed in a stream. In the tunnels, individual drops may be charged selectively. The selected drops are charged and deflected downstream by the presence of deflector plates that have a large potential difference between them. A gutter (sometimes referred to as a "catcher") is normally used to intercept the charged drops and establish a non-print mode, while the uncharged drops are free to strike the recording medium in a print mode as the ink stream is thereby deflected, between the "non-print" mode and the "print" mode.

U.S. Pat. No. 6,079,821, issued to Chwalek et al., Jun. 27, 2000, discloses an apparatus for controlling ink in a continuous ink jet printer. The apparatus includes a source of pressurized ink communicating with an ink delivery channel. A nozzle bore opens into the ink delivery channel to establish a continuous flow of ink in a stream with the nozzle bore defining a nozzle bore perimeter. A heater causes the stream to break up into a plurality of droplets at a position spaced from the nozzle bore. The heater has a selectively-actuated section associated with only a portion of the nozzle bore perimeter such that actuation of the heater section produces an asymmetric application of heat to the stream to control the direction of the stream between a print direction and a non-print direction.

U.S. Pat. Nos. 6,554,410 and 6,588,888, both of which issued to Jeanmaire et al., on Apr. 29, 2003 and Jul. 8, 2003, respectively, disclose continuous ink jet printing systems which use a gas flow to control the direction of the ink stream between a print direction and a non-print direction. Controlling the ink stream with a gas flow reduces the amount of energy consumed by the printing system.

Drop-on-demand printing systems incorporating a heater in some aspect of the drop forming mechanism are known. Often referred to as "bubble jet drop ejectors", these mechanisms include a resistive heating element(s) that, when actuated (for example, by applying an electric current to the resistive heating element(s)), vaporize a portion of a liquid contained in a liquid chamber creating a vapor bubble. As the vapor bubble expands, liquid in the liquid chamber is expelled through a nozzle orifice. When the mechanism is de-actuated (for example, by removing the electric current to the resistive heating element(s)), the vapor bubble collapses allowing the liquid chamber to refill with liquid.

U.S. Pat. No. 6,460,961 B2, issued to Lee et al., on Oct. 8, 2002, discloses resistive heating elements that, when actuated, form a vapor bubble (or "virtual" ink chamber) around a nozzle orifice to eject ink through the nozzle orifice. However, these types of liquid emitting devices have nozzle orifices that share a common ink chamber. As such, adjacent nozzle orifices are susceptible to nozzle cross talk when corresponding resistive heating elements are actuated.

Attempts have been made to reduce nozzle cross talk. For example, U.S. Pat. No. 6,439,691 B1, issued to Lee et al., on Aug. 27, 2002, positions barriers at various locations in the common ink chamber. This, however, increases the complexity associated with manufacturing the liquid emitting device because the common ink chamber is maintained. U.S. Pat. Nos. 6,102,530 and 6,273,553, issued to Kim et al., on Aug. 15, 2000, and Aug. 14, 2001, respectively, also attempt to reduce nozzle cross talk by offsetting each nozzle orifice relative to the common ink chamber. Doing this, however, provides only one refill port necessary to refill the portion of the ink chamber located under the nozzle orifice. Having only one refill port can reduce overall speeds associated with ejecting the liquid because the time associated with chamber refill is increased.

SUMMARY OF THE INVENTION

According to a feature of the present invention, a print head includes a body. Portions of the body define an ink delivery channel and other portions of the body defining a nozzle bore. The nozzle bore is in fluid communication with the ink delivery channel. An obstruction having an imperforate surface is positioned in the ink delivery channel.

According to another feature of the present invention, a print head includes a fluid delivery channel. A nozzle bore is in fluid communication with the fluid delivery channel. A heater is positioned proximate to the nozzle bore. An insulating material is located between the heater and at least one of the fluid delivery channel and the nozzle bore. An obstruction having an imperforate surface is positioned in the fluid delivery channel.

According to another feature of the present invention, a liquid emission device includes a body. Portions of the body define a fluid delivery channel. Other portions of the body define a nozzle bore. The nozzle bore is in fluid communication with the fluid delivery channel. An obstruction having an imperforate surface is positioned in the fluid delivery channel. A drop forming mechanism is operatively associated with the nozzle bore. An insulating material is positioned between drop forming mechanism and the body.

According to another feature of the present invention, a liquid emission device includes an ink delivery channel. A nozzle bore is in fluid communication with the ink delivery channel. An ink drop forming mechanism is operatively associated with the nozzle bore. An obstruction having an imperforate surface is positioned in the ink delivery channel.

DETAILED DESCRIPTION OF THE INVENTION

The present description will be directed, in particular, to elements forming part of, or cooperating directly with, apparatus or processes of the present invention. It is to be understood that elements not specifically shown or described may take various forms well known to those skilled in the art.

As described herein, the present invention provides a liquid emission device and a method of operating the same. The most familiar of such devices are used as print heads in inkjet printing systems. The liquid emission device described herein can be operated in a continuous mode and/or in a drop-on-demand mode.

Many other applications are emerging which make use of devices similar to inkjet print heads, but which emit liquids (other than inks) that need to be finely metered and deposited with high spatial precision. As such, as described herein, the term liquid refers to any material that can be ejected by the liquid emission device described below.

Figure 1:
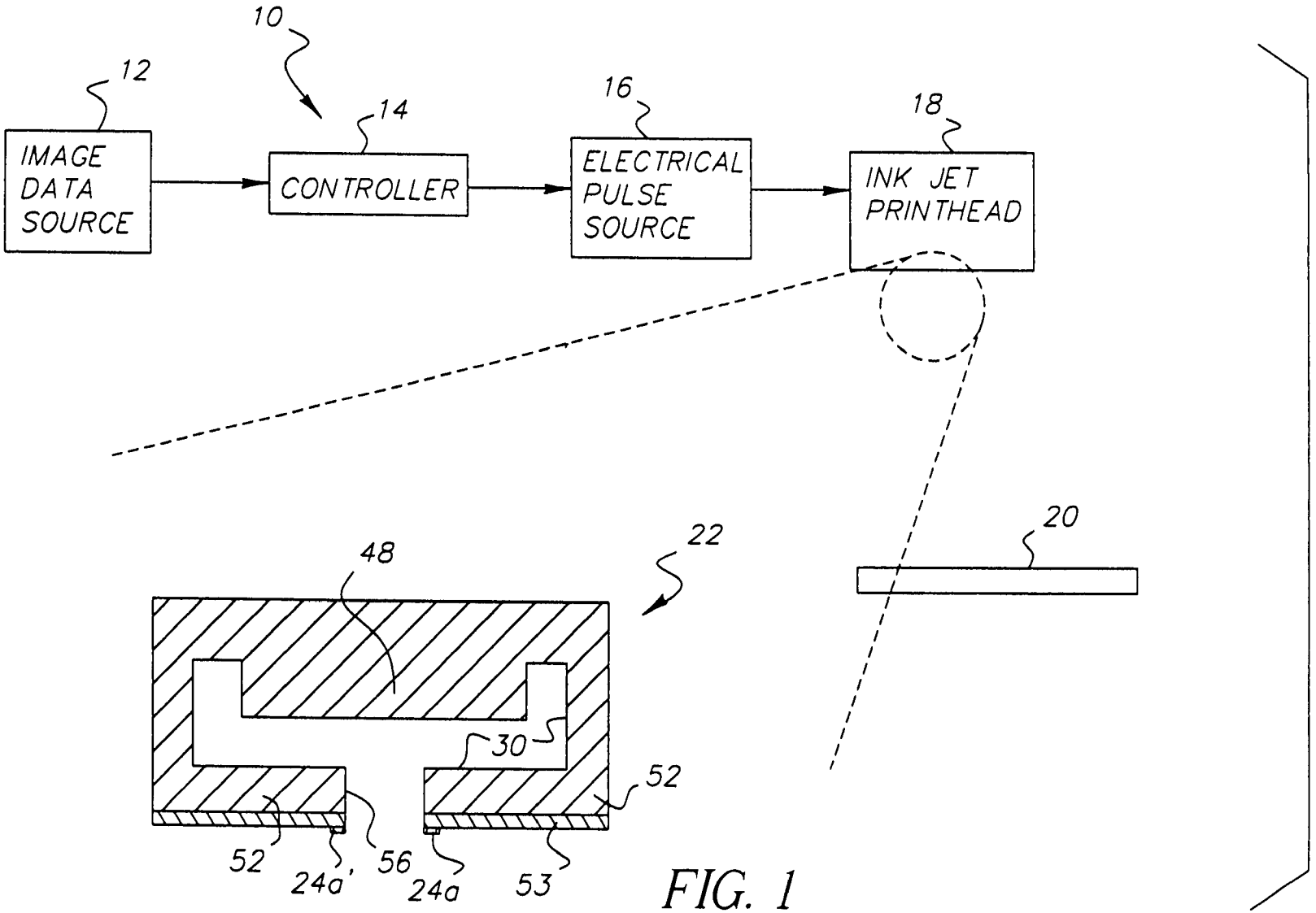
FIG. 1 is a schematic illustration of a liquid emission device according to the present invention.

Referring to FIG. 1, a schematic representation of a liquid emission device 10, such as an inkjet printer, is shown. The system includes a source 12 of data (say, image data) which provides signals that are interpreted by a controller 14 as being commands to emit drops. Controller 14 outputs signals to a source 16 of electrical energy pulses which are inputted to the liquid emission device, for example, an inkjet print head 18. During operation, liquid, for example, ink, is deposited on a recording medium 20. Typically, liquid emission device 10 includes a plurality of ejection mechanisms 22.

Figure 2:
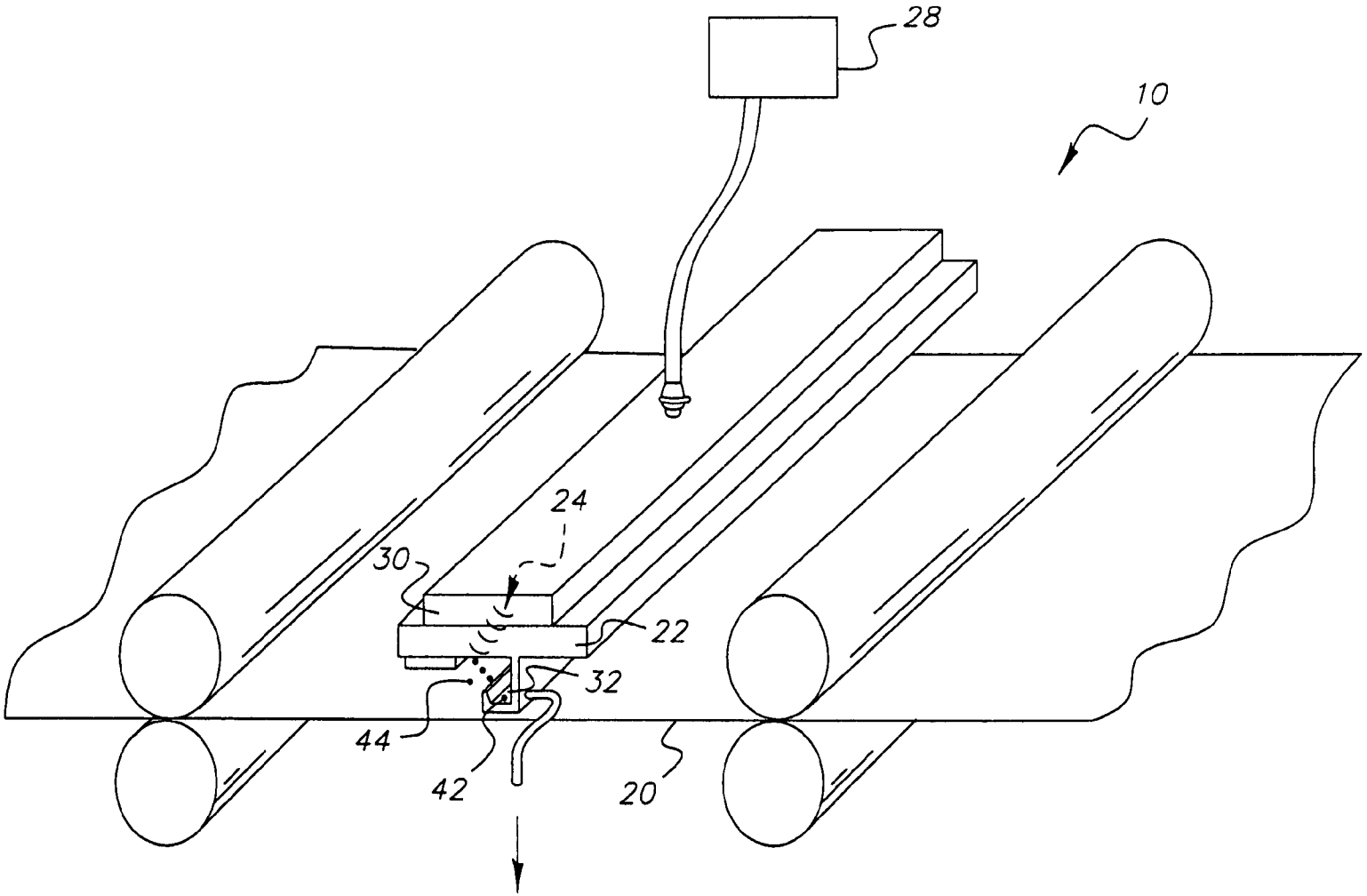
FIG. 2 is a schematic illustration of the liquid emission device configured as a continuous ink jet print head and printing system.

Referring to FIG. 2, print head 18 of liquid emission device 10 is shown configured as a continuous ink jet printer system. Print head 18 includes a plurality of ejection mechanisms 22 forming an array of nozzles with each nozzle of the array being associated with a drop forming mechanism (for example, nozzle heater(s) 24). Print head 18 also houses heater control circuits 26 (shown schematically in FIG. 4) which process signals from controller 14. Heater control circuits 26 take data from the image memory 12, and send time-sequenced electrical pulses to the array of nozzle heaters 24. These pulses are applied at an appropriate time, and to the appropriate nozzle, so that drops formed from a continuous ink jet stream will form spots on recording medium 20, in the appropriate position designated by the data sent from the image memory. Pressurized ink travels from an ink reservoir 28 to an ink delivery channel 30 and through nozzle array 22 onto either the recording medium 20 or a gutter 32.

Figure 3:
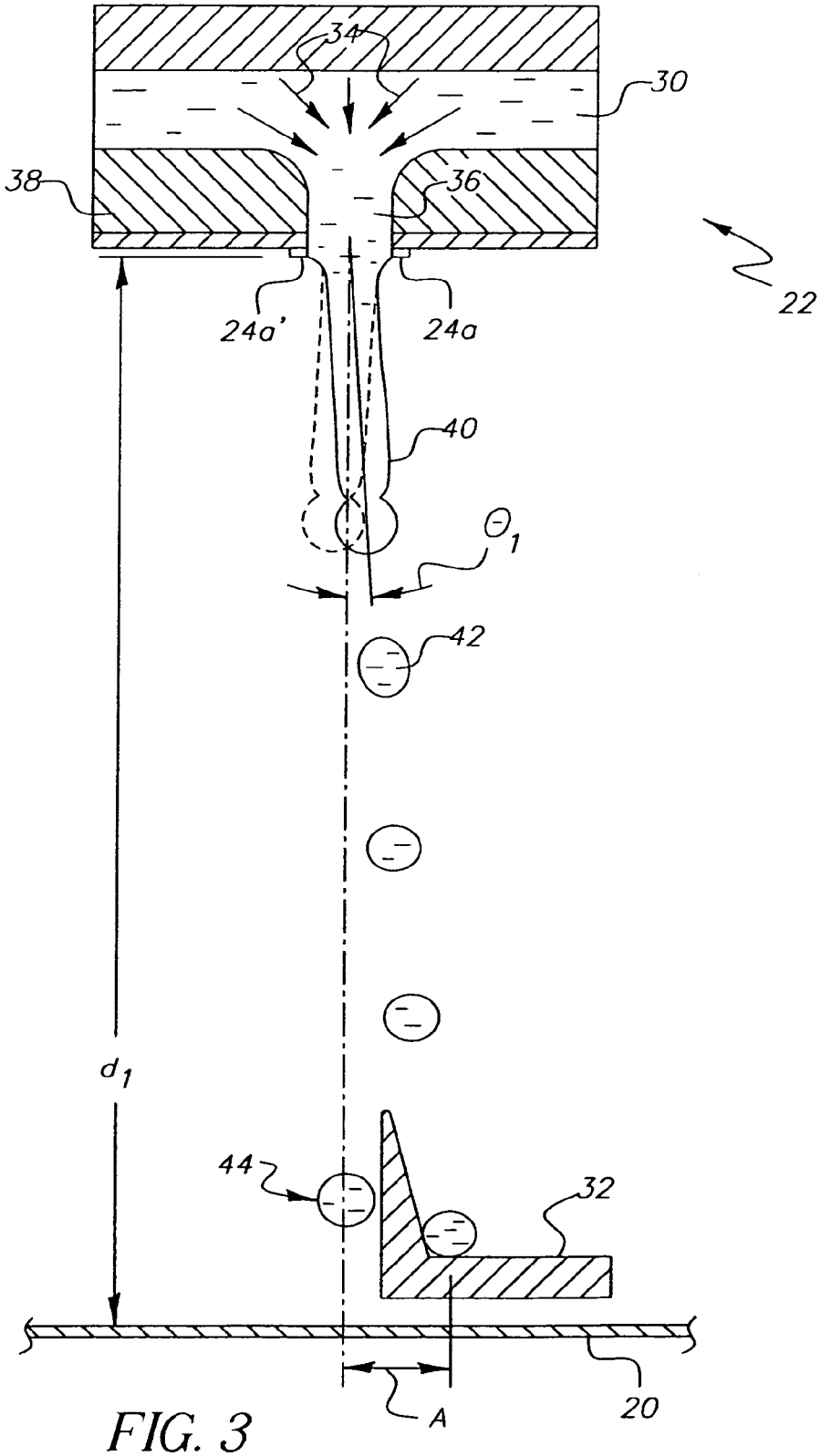
FIG. 3 (PRIOR ART)
FIG. 3 is a cross-sectional view of one nozzle from a prior art nozzle array showing $d_1$ (distance to print medium) and $\theta_1$ (angle of deflection)

Referring to FIG. 3, an enlarged cross-sectional view of a single nozzle of ejection mechanism 22 from the nozzle array shown in FIG. 2 is shown as it is in the prior art. Note that ink delivery channel 30 shows arrows 34 that depict a substantially vertical flow pattern of ink headed into nozzle bore 36. There is a relatively thick wall 38 which serves, inter alia, to insulate the ink in the channel 30 from heat generated by the nozzle heater sections 24*a*/24*a*' (described below). Wall 38 may also be referred to as an "orifice membrane." An ink stream 40 forms from a meniscus of ink initially leaving the nozzle bore 36. At a distance below the nozzle bore 36 ink stream 40 breaks into a plurality of drops 42, 44.

Figure 4:
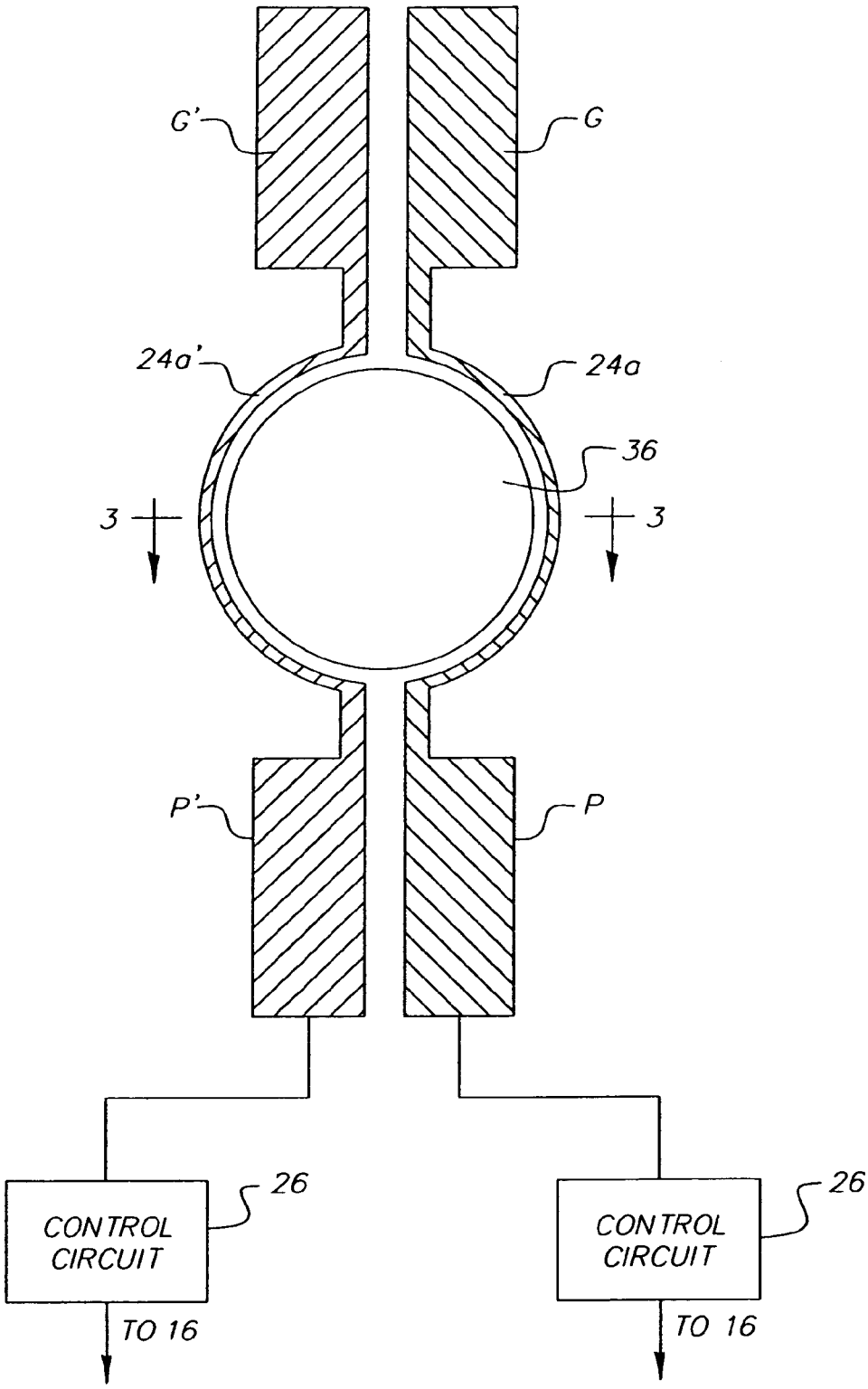
FIG. 4 is a top view of a nozzle having an asymmetric heater positioned around the nozzle.

Referring to FIG. 4, and back to FIG. 3, an expanded bottom view of heater 24 is shown. Line 3—3, along which line the FIG. 3 cross-sectional illustration is also shown. Heater 24 has two sections (heater sections 24*a* and 24*a*'). Each section 24*a* and 24*a*' covers approximately one half of the nozzle bore opening 36. Alternatively, heater sections can vary in number and sectional design. One section provides a common connection G, and isolated connection P. The other has G' and P' respectively. Asymmetrical application of heat merely means applying electrical current to one or the other section of the heater independently. By so doing, the heat will deflect the ink stream 40, and deflect the drops 42, for example, away from the particular source of the heat. For a given amount of heat, the ink drops 42 are deflected at an angle $\theta_1$ (in FIG. 3) and will travel a vertical distance $d_1$ to gutter 32 (or onto recording media 20) from print head 18. There also is a distance "A", which distance defines the space between where the deflection angle $\theta_1$ would place the deflected drops 42 in gutter 32 or on recording medium 20 and where the drops 44 would have landed without deflection. The stream deflects in a direction anyway from the application of heat. The ink gutter 32 is configured to catch deflected ink droplets 42 while allowing undeflected drop 44 to reach a recording medium. An alternative embodiment of the present invention could reorient ink gutter (or catcher) 32 to be placed so as to catch undeflected drops 44 while allowing deflected drops 42 to reach the recording medium 20.

The ink in the delivery channel emanates from pressurized reservoir 28 (shown in FIG. 2) leaving the ink in the channel under pressure. In the past the ink pressure suitable for optimal operation would depend upon a number of factors, particularly geometry and thermal properties of the nozzles and thermal properties of the ink. A constant pressure can be achieved by employing an ink pressure regulator (not shown).

Figure 5:
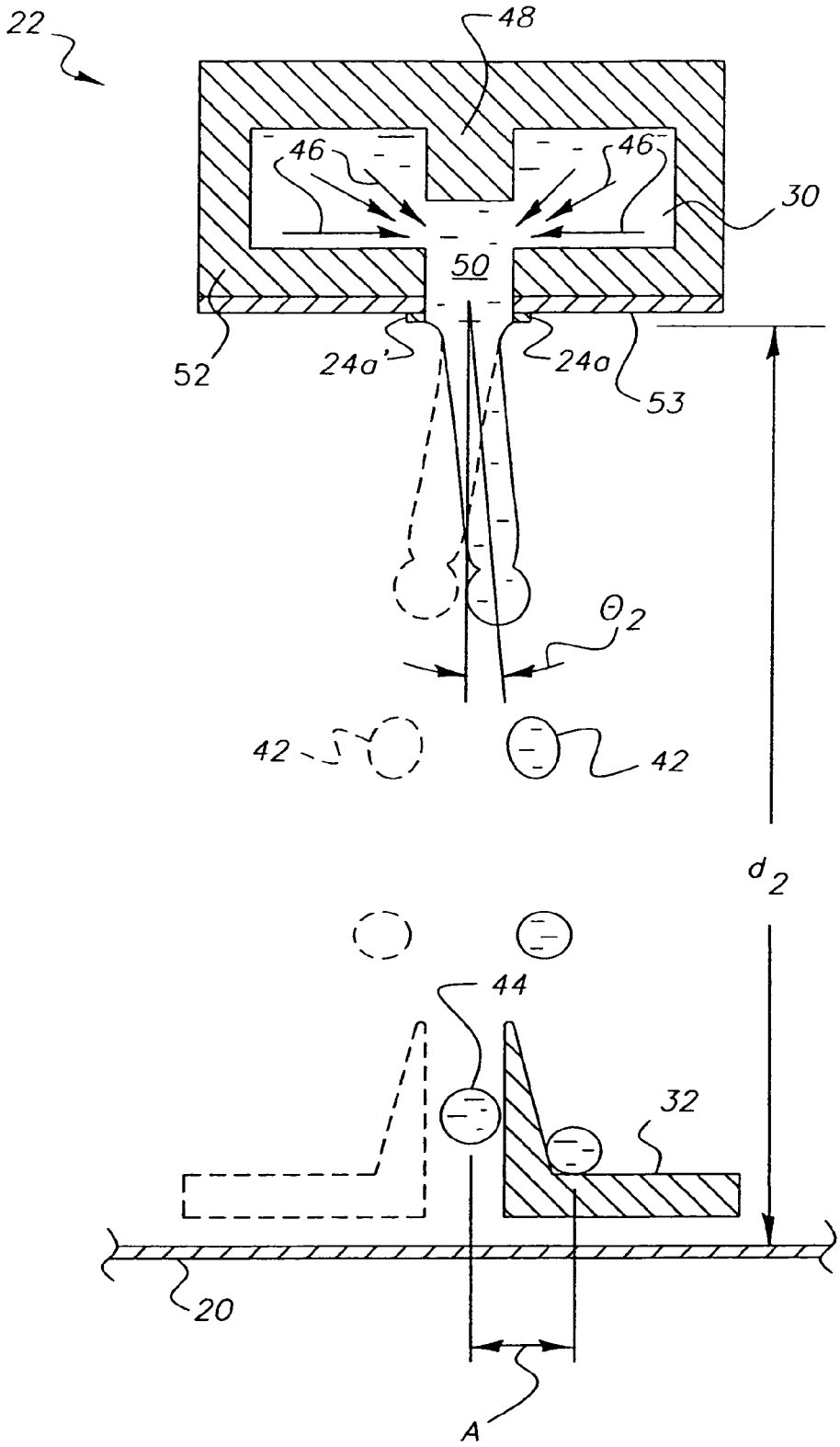
FIG. 5 is a cross-sectional view of one nozzle incorporating one embodiment of the present invention showing $d_2$ and $\theta_2$.
Figure 6:
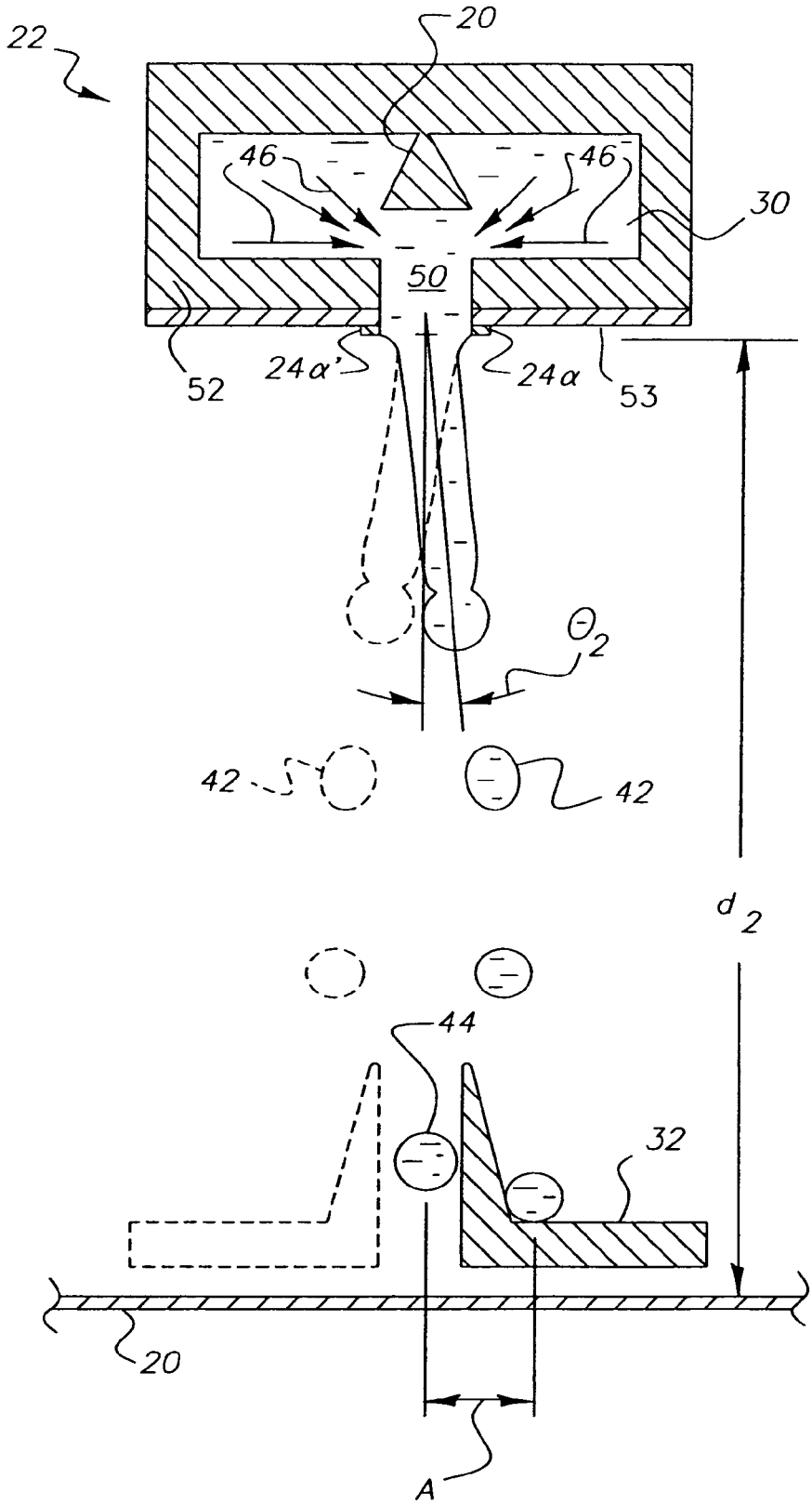
FIG. 6 is a cross-sectional view of one nozzle incorporating another embodiment of the present invention.

Referring to FIGS. 5 and 6, during operation, the lateral course of ink flow patterns 46 in the ink delivery channel 30, are enhanced by, a geometric obstruction 48, placed in the delivery channel 30, just below the nozzle bore 50. This lateral flow enhancing obstruction 48 can be varied in size, shape and position, and serves to improve the deflection, based upon the lateralness of the flow and can therefore reduce the dependence upon ink properties (i.e. surface tension, density, viscosity, thermal conductivity, specific heat, etc.), nozzle geometry, and nozzle thermal properties while providing greater degree of control and improved image quality. Preferably the obstruction 48 has a lateral wall parallel to the reservoir side of wall 52, and cross sectional shapes such as squares, rectangles, triangles (shown in FIG. 6 with like features being represented using like reference symbols), etc. Wall 52 can serve to insulate portions of ejection mechanism 22 in a manner similar to, or identical to, wall 38 (discussed above). Ejection mechanism 22 can include additional material layer(s) 53 stacked on wall 52. Layer(s) 53 can also serve to insulate other portions of mechanism from the heat generated by heater 24.

The deflection enhancement may be seen by comparing for example the margins of difference between $\theta_1$ of FIG. 3 and $\theta_2$ of FIG. 5. This increased stream deflection enables improvements in drop placement (and thus image quality) by allowing the recording medium 20 to be placed closer to the print head 18 ($d_2$ is less than $d_1$) while preserving the other system level tolerances (i.e. spacing, alignment etc.) for example see distance A. The orifice membrane or wall 52 can also be thinner. We have found that a thinner wall provides additional enhancement in deflection which, in turn, serves to lessen the amount of heat needed per degree of the angle of deflection $\theta_2$.

Figure 7:
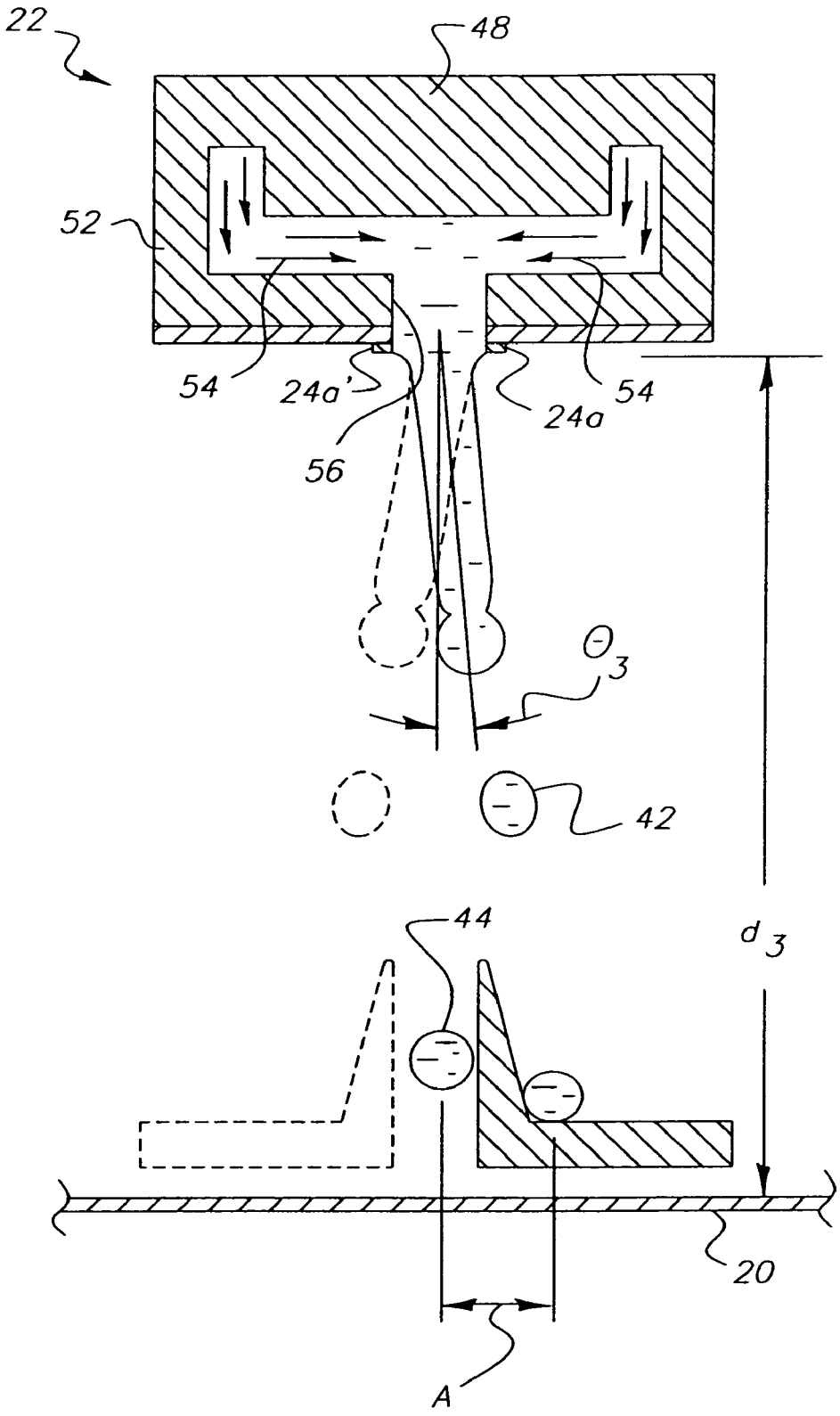
FIG. 7 is a cross-sectional view of one nozzle incorporating a preferred embodiment of the present invention showing $d_3$ and $\theta_3$.

Referring to FIG. 7, drop placement and thus image quality can be even further enhanced by an obstruction 48 which provides almost total lateral flow 54 at the entrance to nozzle bore 56. Again, wall 52 can serve to insulate portions of ejection mechanism 22 like wall 38 (discussed above). Ejection mechanism 22 can include additional material layer(s) 53 stacked on wall 52. Layer(s) 53 can also serve to insulate other portions of mechanism from the heat generated by heater 24. The distance $d_3$ to print medium 20 is again lessened per degree of heat because deflection angle $\theta_3$ can be increased per unit temperature.

Figure 8:
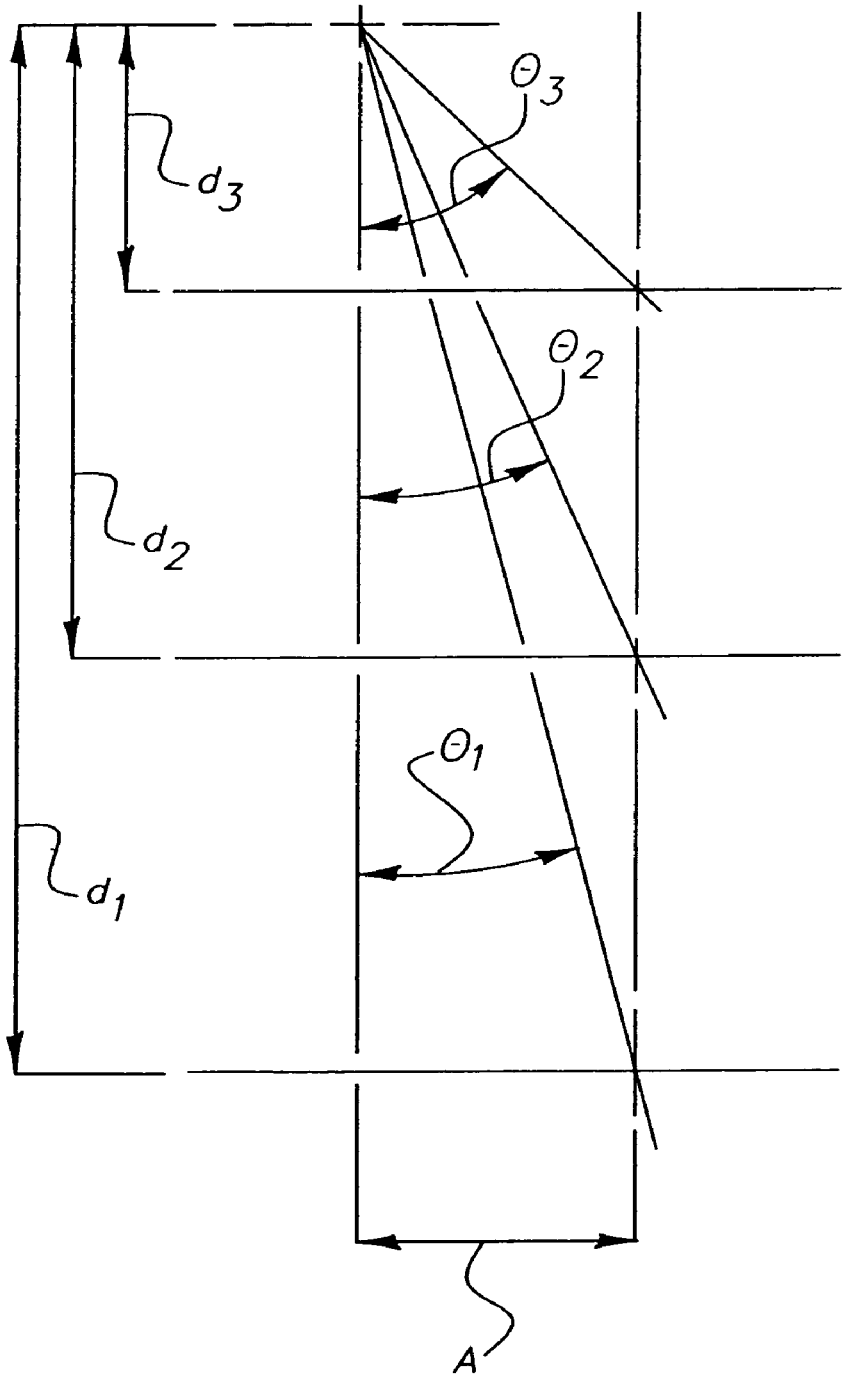
FIG. 8 is a graph illustrating the relationships between $d_1$–$d_3$, $\theta_1$–$\theta_3$, and A.

FIG. 8 shows the relationship of a constant drop placement A as distances to the print media $d_1$, $d_2$, and $d_3$ become less and less and as deflection angles $\theta_1$, $\theta_2$, and $\theta_3$ become increasingly larger. As a consequence of enhanced lateral flow, the ability to miniaturize the printer's structural dimensions while enhancing image size and enhancing image detail is achieved.

Figure 9:
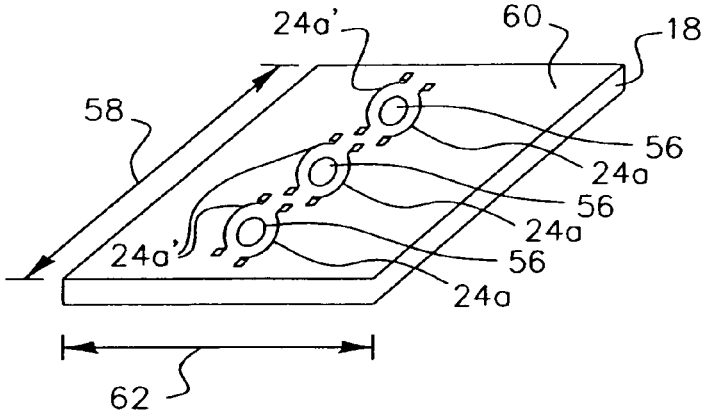
FIG. 9 is a perspective top view of the liquid emission device according to the present invention.
Figure 10:
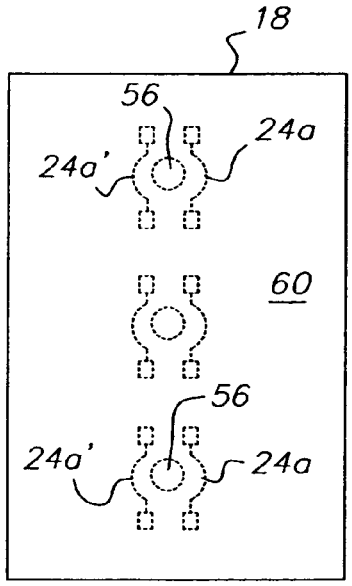
FIG. 10 is a top view of the liquid emission device according to the present invention.
Figure 11:
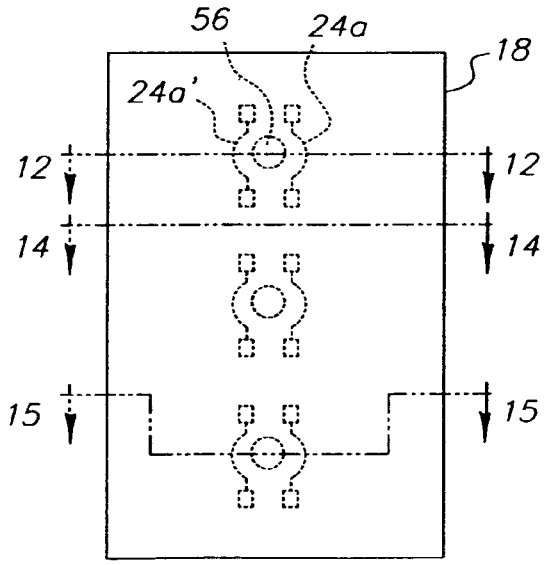
FIG. 11 is a bottom view of the liquid emission device according to the present invention.

Referring to FIGS. 9–11, print head 18 of liquid emission device 10 includes a plurality of ejection mechanisms 22 positioned in a linear array along a length dimension 58 of print head 18. Ejection mechanisms 22 can be positioned in other types of arrays, for example, two dimensional arrays in which nozzle bores 56 are aligned in rows or staggered in rows. Other positions known in the art are also permitted. Ejection mechanism 22 includes a drop forming mechanism operatively associated with a nozzle bore 56. In FIGS. 9–11, the drop forming mechanism includes a heater 24 positioned about a nozzle bore 36. Heater 24 has been described above with reference to FIGS. 3 and 4. Heater 24 can be positioned about nozzle bore 36 on a top surface 60 of a material layer, for example, one of layers 52 or 53. Alternatively, heater 24 can be positioned within a material layer, for example, one of layers 52 or 53. Print head 18 also includes a width dimension 62.

Figure 12:
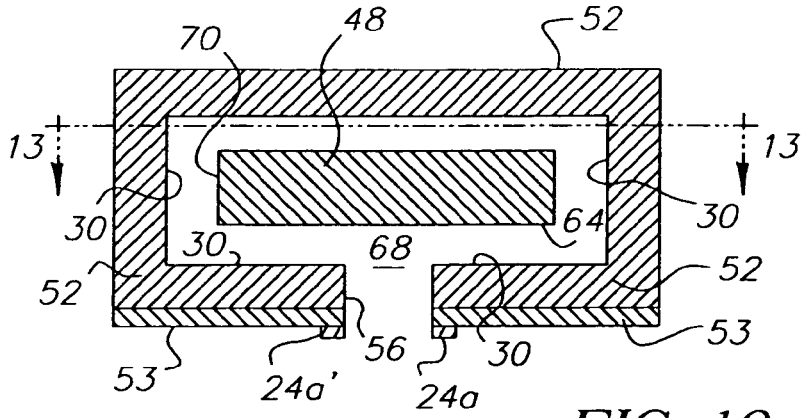
FIG. 12 is a cross-sectional side view of one ejection mechanism of the liquid emission device shown in FIG. 11 as shown along line 12—12.

Referring to FIG. 12, a cross-sectional view of one of the plurality of thermally actuated drop ejection mechanisms 22 is shown. Nozzle bore 56 is formed in wall 52 and any additional material layer(s) present, for example, material layer 53, for each ejection mechanism 22. When additional material layer(s) 53 are present, the additional layers are stacked on top of one another, as is known in the art and commonly referred to as a dielectric stack.

Obstruction 48 is positioned in delivery channel 30. Obstruction 48 can be centered over nozzle bore 56 with a lateral wall 64 that extends perpendicular to nozzle bore 56 as viewed along a plane that is perpendicular to nozzle bore 56, as shown in FIG. 12. Lateral wall 64 is also typically positioned parallel to wall 52 and spaced apart from wall 52 such that delivery channel 30 intersects nozzle bore 56.

A surface 66 of wall 64 is imperforate which causes fluid in delivery channel 30 to flow around obstruction 48 to arrive at and pass through nozzle bore 56. Imperforate surface 66 at least partially creates lateral flow 54 when ejection mechanism 22 is operated in a continuous manner, as described above. Imperforate surface 66 also at least partially creates ejection chamber 68 when ejection mechanism 22 is operated in a drop on demand manner, described below.

A vertical wall or walls 70 of obstruction 48 is positioned in delivery channel 30 at a location relative to nozzle bore 56 that causes surface 66 to overlap nozzle bore 56. This helps to further define ejection chamber 68 and/or create lateral flow 54. Alternatively, vertical wall(s) 70 can be located such that surface 66 extends through the diameter of nozzle bore 56, as shown in FIGS. 5 and 6.

Heater 24 is operatively associated with nozzle bore 56 and in FIG. 12 is shown positioned on an outer surface of material layer 53. However, as described above, heater 24 can be located in other areas as long as heater 24 is operatively associated with nozzle bore 56. These other areas can include, for example, on a surface of wall 52, within wall 52, partially within wall 52, partially within material layer 53, within material layer 53, etc. Additional heater(s) 24 can be included within ejection chamber 68. For example, heater(s) 24 can be positioned on obstruction 48.

Figure 13:
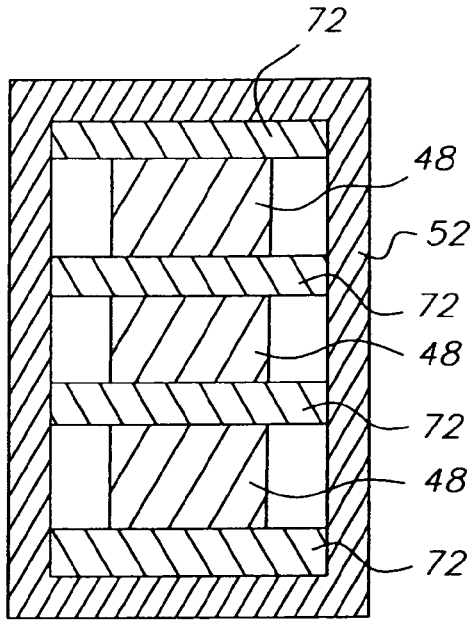
FIG. 13 is a cross-sectional side view of one ejection mechanism of the liquid emission device shown in FIG. 12 as shown along line 13—13.

Referring to FIG. 13, another cross-sectional view of thermally actuated drop ejection mechanism 22 is shown. In FIG. 13, print head 18 is shown including a plurality of ejection mechanisms 22. Delivery channel 30 supplies liquid (for example, ink) from source 28 through nozzle bores 56. An obstruction 48 is positioned in delivery channel 30 relative to each nozzle bore 56, as described above. As such, it can be said that each ejection mechanism 22 includes an individual obstruction 48. Obstruction 48 is supported by wall(s) 72. Typically, this is accomplished by integrally forming each obstruction 48 with wall(s) 72 during the ejection mechanism 22 fabrication process. However, obstruction 48 can be supported relative to nozzle bore 56 is any known manner provided delivery channel 30 has access to nozzle bore 56.

Figure 14:
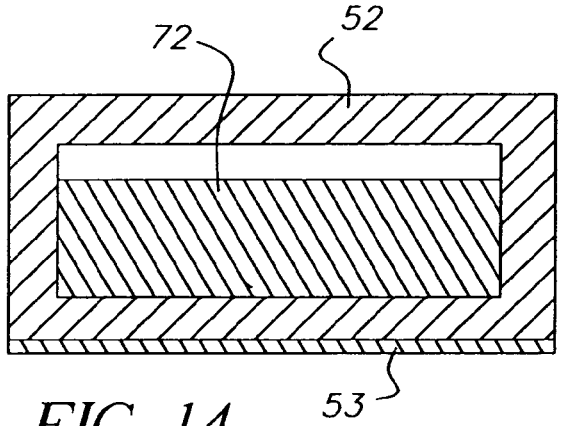
FIG. 14 is a cross-sectional side view of one ejection mechanism of the liquid emission device shown in FIG. 11 as shown along line 14—14.

Referring to FIGS. 13 and 14, wall(s) 72 are positioned on opposing sides of nozzle bore 56 perpendicular to the length dimension 58 of print head 18. Wall(s) 72 are also typically positioned parallel to the width dimension 62 of print head 18. However, wall(s) 72 can be positioned at other angles relative to the length dimension 58 and width dimension 62 depending on the location pattern of each nozzle bore 56.

Referring to FIG. 14, another cross-sectional view of ejection mechanism 22 is shown. As shown in FIG. 14, wall 72 does not extend to wall 52 on the side of wall 52 opposite nozzle bore 56, but does extend to wall 52 on the side of wall 52 that includes nozzle bore 56. As such, delivery channel 30 has access to multiple nozzle bores 56 while the location of wall(s) 72 helps to define ejection mechanism 22. The positioning of wall(s) 72 reduces problems that typically occur when multiple nozzle bores share a common delivery channel (nozzle to nozzle cross talk, etc.) while still providing source 28 with access to a plurality of nozzle bores 56 through delivery channel 30.

Figure 15:
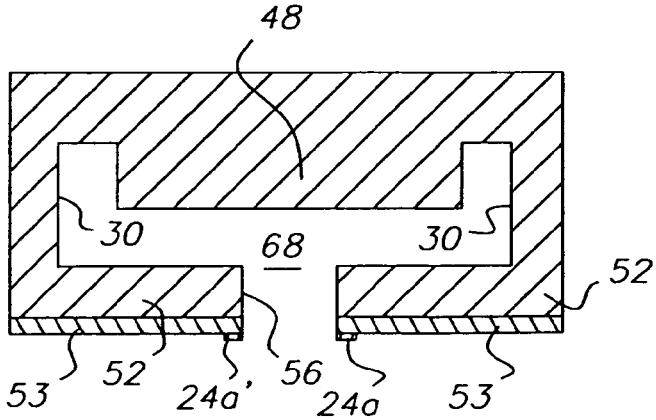
FIG. 15 is a cross-sectional bottom view of one ejection mechanism of the liquid emission device shown in FIG. 11 as shown along line 15—15.

Referring to FIG. 15, another cross-sectional view of ejection mechanism 22 is shown with like features being represented using like reference signs. The cross-sectional view of ejection mechanism 22 is the same cross-sectional view of ejection mechanism 22 shown in FIGS. 1 and 7 above and FIGS. 17–20 below.

Figure 16:
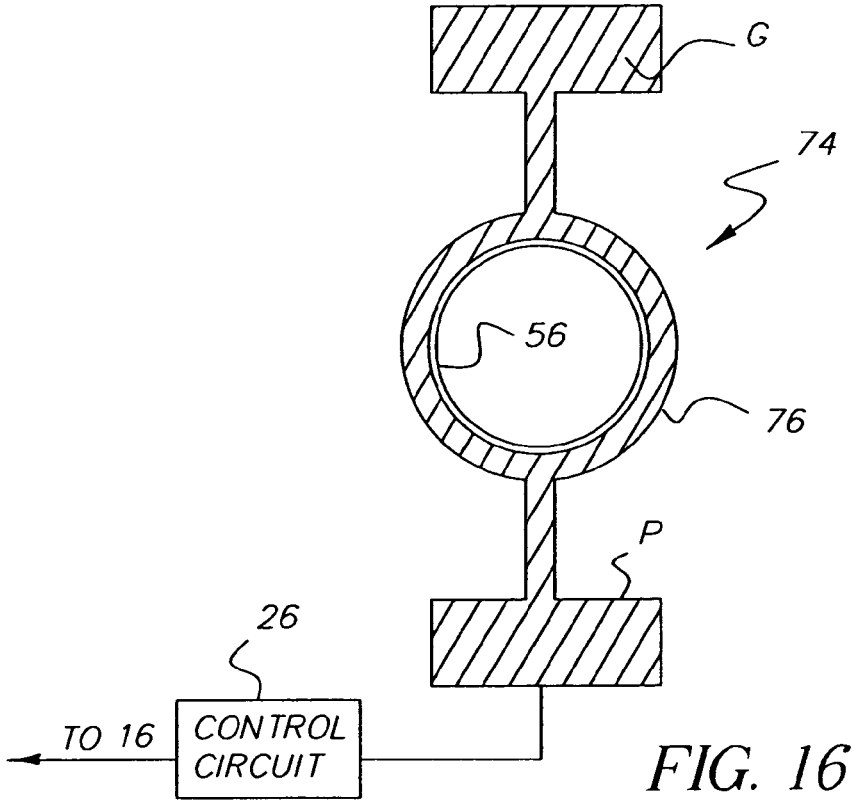
FIG. 16 is an alternative embodiment of a drop forming mechanism.
Figure 17:
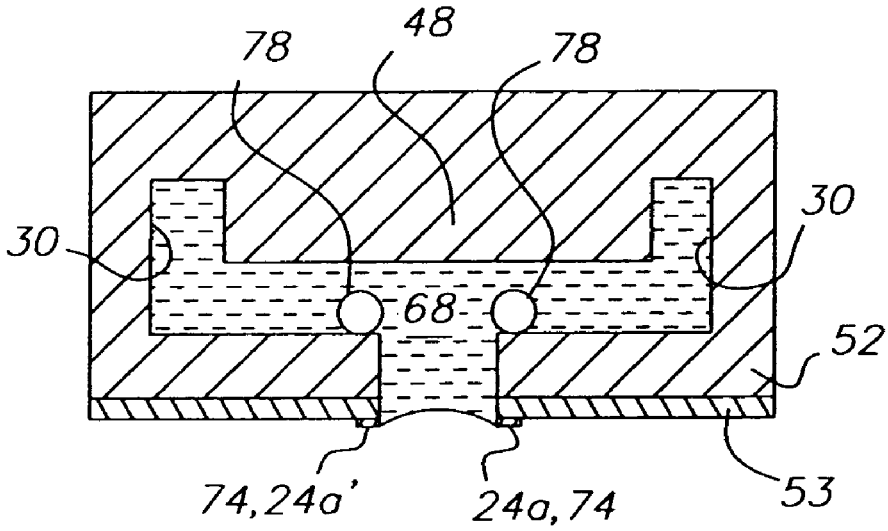
FIGS. 17–20 illustrate operation of the liquid emission device configured as a drop on demand print head.
Figure 18:
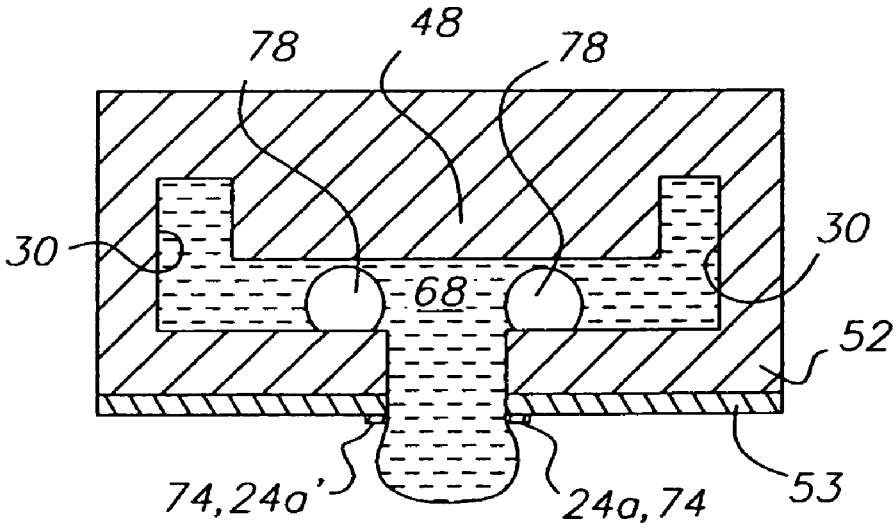
Figure 19:
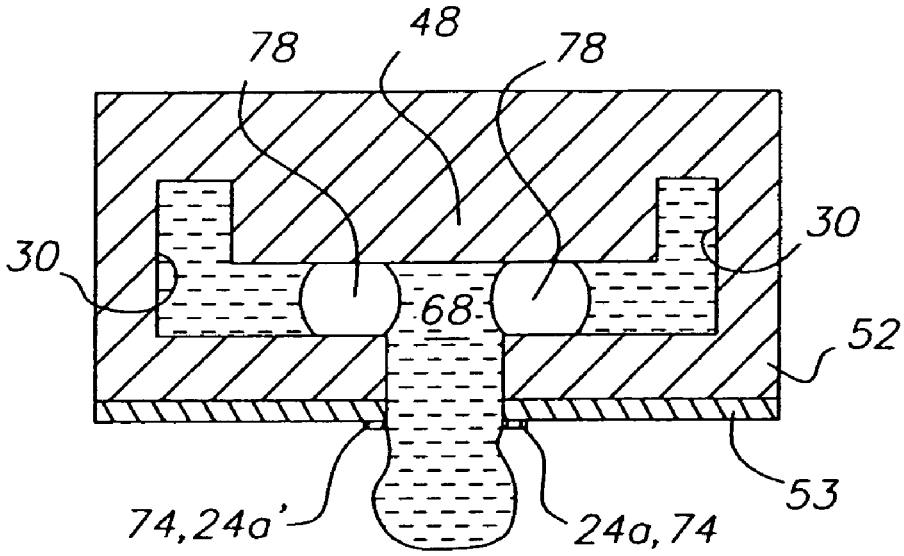
Figure 20:
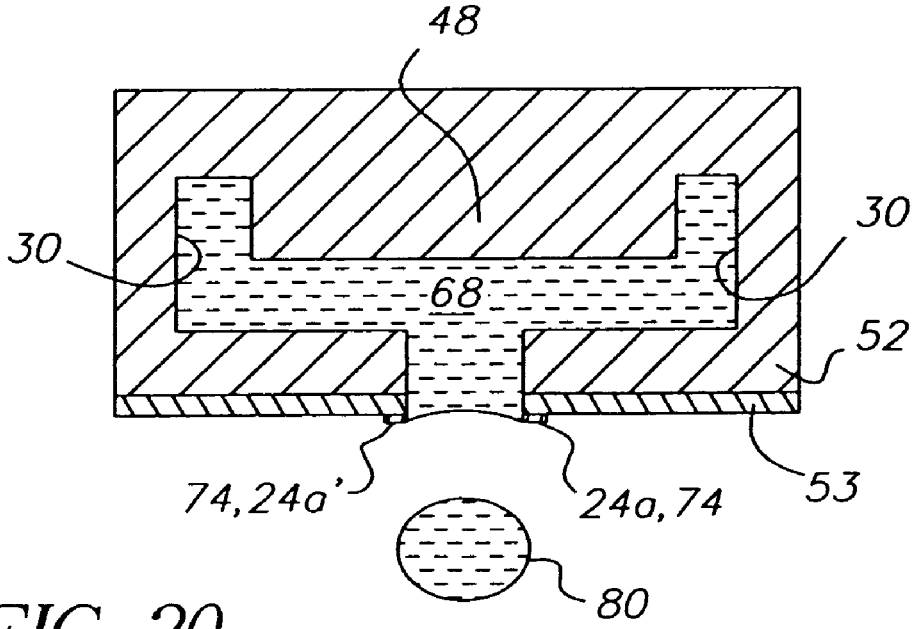

Referring to FIG. 16, an alternative embodiment of heater 24 is shown. In this embodiment, heater 74 has an annular portion 76 and is positioned around nozzle bore 56. Heater 74 also has a common connection G and a connection P connected to annular portion 76. In this embodiment, heater 74 is actuated as a whole.

Referring to FIGS. 17–20 and back to FIG. 1, operation of ejection mechanism 22 in a drop on demand mode will be described. Controller 14 outputs a signal to source 16 that causes source 16 to deliver an actuation pulse to heater 24 (or 74). The actuation of heater 24 (or 74) causes a portion of the fluid (for example, ink) typically maintained under a slight negative pressure in ejection chamber 68 to vaporize forming vapor bubble(s) 78. Vapor bubble(s) 78 expands forcing fluid in ejection chamber 68 to be ejected through nozzle bore 56 in the form of a drop 80. The direction of vapor bubble(s) 78 expansion is opposite to the direction of drop 80 ejection. Vapor bubble(s) 78 collapse after heater 24 (or 74) is de-energized. This allows delivery channels 30 to refill ejection chamber 68. The process is repeated when an additional fluid drop(s) is desired.

In another example embodiment, vapor bubble(s) 78 expand at least partially sealing ejection chamber 68 from delivery channels 30. The expansion of vapor bubble(s) 78 also forces fluid in ejection chamber 68 to be ejected through nozzle bore 56 in the form of a drop 80. The direction of vapor bubble(s) 78 expansion is opposite to the direction of drop 80 ejection. Vapor bubble(s) 78 collapse after heater 24 (or 74) is de-energized. This allows delivery channels 30 to refill ejection chamber 68. The process is repeated when an additional fluid drop(s) is desired.

In another example embodiment, vapor bubble(s) 78 expand and contact obstruction 48 (or a portion of wall 52) sealing ejection chamber 68 from delivery channels 30. The expansion of vapor bubble(s) 78 also forces fluid in ejection chamber 68 to be ejected through nozzle bore 56 in the form of a drop 80. The direction of vapor bubble(s) 78 expansion is opposite to the direction of drop 80 ejection. Vapor bubble(s) 78 collapse after heater 24 (or 74) is de-energized. This allows delivery channels 30 to refill ejection chamber 68. The process is repeated when an additional fluid drop(s) is desired.

Heater 24 (or 74) activation pulse can take the shape of any wave form (including period, amplitude, etc.) known in the industry. For example, heater 24 (or 74) activation pulse can be shaped like one of the waves forms, or a combination of the wave forms, disclosed in U.S. Pat. No. 4,490,728, issued to Vaught et al. on Dec. 25, 1984. However, other wave form shapes are also possible.

Although ejection mechanism 22 can be fabricated such that one or more delivery channels 30 feed ejection chamber 68, it has been discovered that two delivery channels 30 adequately allow ejection chamber 68 to be refilled without sacrificing fluid ejection speeds while reducing nozzle to nozzle cross talk. However, alternative embodiments of ejection mechanism 22 can include more or less delivery channels 30 feeding ejection chamber 68 depending on the application specifically contemplated for ejection mechanism 22.

Additionally, positioning delivery channels 30 on opposing sides of ejection chamber 68 facilitates implementation of heater 24 having individually actuateable sections 24*a* and 24*a*' as the drop forming mechanism. Heater section 24*a* is positioned to seal off one delivery channel 30 when section 24*a* is activated while heater section 24*a*' is positioned to seal off the other delivery channel 30 when section 24*a*' is activated.

Experimental Results

An ejection mechanism 22 was fabricated using known CMOS and/or MEMS fabrication techniques. Ejection mechanism 22 included a nozzle bore 56 (having a diameter of approximately 10 microns) and a heater 24 (or 74) (having a width of approximately 2 microns) positioned approximately 0.6 microns from nozzle bore 56. Heater 24 (or 74) was positioned on wall (or "orifice membrane") 52 (having a thickness of approximately 1.5 microns). Obstruction 48 in conjunction with walls 52 formed ejection chamber 68. (Ejection chamber 68 had a height of approximately 4 microns, the distance between wall 52 and obstruction 48, and a width of approximately 30 microns, the distance between delivery channels or the width of obstruction 48). Ejection chamber 68 was in fluid communication with two delivery channels 30 (each delivery channel having dimensions of approximately 30 microns×120 microns).

Experimental ejection mechanism 22 was operated in the manner described above. Heater 24 (or 74, a 234 ohm heater) was supplied through a cable with a 6 volt electrical pulse having a duration of approximately 2.8 microseconds causing a drop of approximately 1 pico-liter to be ejected through nozzle bore 56. The energy required to accomplish this was approximately 0.4 micro-joules. Subsequent math modeling, a common form of experimentation in the CMOS and/or MEMS industry, has shown that this energy requirement can be substantially reduced to approximately 0.2 micro-joules or less.

The invention has been described in detail with particular reference to certain preferred embodiments thereof, but it will be understood that variations and modifications can be effected within the scope of the invention.

What is claimed is:

1. A print head comprising:

a body, portions of the body defining an ink delivery channel, other portions of the body defining a nozzle bore, the nozzle bore being in fluid communication with the ink delivery channel; and an obstruction having an imperforate surface positioned in the ink delivery channel, wherein at least a portion of the obstruction overlaps the nozzle bore.

2. The print head according to claim 1, wherein the obstruction is centered over the nozzle bore.

3. The print head according to claim 1, the ink delivery channel having at least one wall, wherein the obstruction is attached to the at least one wall.

4. The print head according to claim 1, the ink delivery channel having at least one wall, wherein the obstruction is integrally formed with the at least one wall.

5. The print head according to claim 1, further comprising:

an ink drop forming mechanism operatively associated with the nozzle bore.

6. The print head according to claim 5, wherein the ink drop forming mechanism is positioned on the print head at a location other than the obstruction.

7. The print head according to claim 5, wherein the ink drop forming mechanism is a heater.

8. The print head according to claim 7, wherein the heater includes a selectively actuated section.

9. The print head according to claim 1, the obstruction having a lateral wall, wherein the lateral wall of the obstruction is positioned in the ink delivery channel parallel to the nozzle bore as viewed from a plane perpendicular to the nozzle bore.

10. The print head according to claim 1, the nozzle bore having a diameter, the obstruction having a vertical wall, wherein the vertical wall of the obstruction is positioned in the ink delivery channel at locations extending beyond the diameter of the nozzle bore.

11. The print head according to claim 1, the nozzle bore having a diameter, the obstruction having a vertical wall, wherein the vertical wall of the obstruction is positioned in the ink delivery channel at a location substantially equivalent to the diameter of the nozzle bore.

12. A print head comprising:

a fluid delivery channel;

a nozzle bore in fluid communication with the fluid delivery channel;

a heater positioned proximate to the nozzle bore;

an insulating material located between the heater and at least one of the fluid delivery channel and the nozzle bore; and an obstruction having an imperforate surface positioned in the fluid delivery channel.

13. The print head according to claim 12, wherein the insulating material forms at least a portion of at least one of the nozzle bore and the fluid delivery channel.

14. The print head according to claim 12, wherein the insulating material is positioned between the heater and the material forming the nozzle bore.

15. The print head according to claim 12, wherein the insulating material is positioned between the heater and the material forming the fluid delivery channel.

16. The print head according to claim 12, wherein the heater comprises a plurality of individually actuateable sections.

17. The print head according to claim 12, the obstruction having a lateral wall, wherein the lateral wall of the obstruction is positioned in the ink delivery channel parallel to the nozzle bore as viewed from a plane perpendicular to the nozzle bore.

18. The print head according to claim 12, the nozzle bore having a diameter, the obstruction having a vertical wall, wherein the vertical wall of the obstruction is positioned in the ink delivery channel at locations extending beyond the diameter of the nozzle bore.

19. An emission device comprising:

a body, portions of the body defining a fluid delivery channel, other portions of the body defining a nozzle bore, the nozzle bore being in fluid communication with the fluid delivery channel;

an obstruction having an imperforate surface positioned in the fluid delivery channel;

a drop forming mechanism operatively associated with the nozzle bore; and an insulating material positioned between drop forming mechanism and the body.

20. The emission device according to claim 19, wherein the insulating material forms at least a portion of the body.

21. The emission device according to claim 19, wherein the insulating material is a material layer distinct from the body.

22. The emission device according to claim 19, wherein the ink drop forming mechanism is a heater.

23. The emission device according to claim 22, wherein the heater comprises a plurality of individually actuateable sections.

24. The emission device according to claim 19, the obstruction having a lateral wall, wherein the lateral wall of the obstruction is positioned in the ink delivery channel parallel to the nozzle bore as viewed from a plane perpendicular to the nozzle bore.

25. The emission device according to claim 19, the nozzle bore having a diameter, the obstruction having a vertical wall, wherein the vertical wall of the obstruction is positioned in the ink delivery channel at locations extending beyond the diameter of the nozzle bore.

26. A liquid emission device comprising:

an ink delivery channel;

a nozzle bore in fluid communication with the ink delivery channel;

an ink drop forming mechanism operatively associated with the nozzle bore; and an obstruction having an imperforate surface positioned in the ink delivery channel, wherein at least a portion of the obstruction overlaps the nozzle bore.

27. The device according to claim 26, wherein the obstruction is centered over the nozzle bore.

28. The device according to claim 26, the ink delivery channel having at least one wall, wherein the obstruction is integrally formed with the at least one wall.

29. The device according to claim 26, wherein the ink drop forming mechanism is positioned on the print head at a location other than the obstruction.

30. The device according to claim 26, wherein the ink drop forming mechanism is a heater.

31. The device according to claim 30, wherein the heater comprises a plurality of individually actuateable sections.

* * * * *